US010566735B2

(12) United States Patent
Ashibu

(10) Patent No.: US 10,566,735 B2
(45) Date of Patent: Feb. 18, 2020

(54) CONNECTOR

(71) Applicant: Japan Aviation Electronics Industry, Limited, Tokyo (JP)

(72) Inventor: Kenta Ashibu, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/268,722

(22) Filed: Feb. 6, 2019

(65) Prior Publication Data

US 2019/0319398 A1 Oct. 17, 2019

(30) Foreign Application Priority Data

Apr. 11, 2018 (JP) ..... 2018-076172

(51) Int. Cl.

| | |
|---|---|
| ***H01R 12/52*** | (2011.01) |
| ***H01R 13/627*** | (2006.01) |
| ***H01R 12/73*** | (2011.01) |
| ***H01R 13/405*** | (2006.01) |
| ***H01R 13/631*** | (2006.01) |

(52) U.S. Cl.

CPC ..... *H01R 13/6271* (2013.01); *H01R 12/73* (2013.01); *H01R 13/405* (2013.01); *H01R 13/631* (2013.01)

(58) Field of Classification Search

CPC ..... H01R 12/52; H01R 12/716; H01R 12/71; H01R 13/6582

USPC ..... 439/74, 660, 733.1, 78

See application file for complete search history.

(56) References Cited

U.S. PATENT DOCUMENTS

| | | | | |
|---|---|---|---|---|
| 8,992,234 | B2 * | 3/2015 | Yoshioka | H01R 12/716 439/74 |
| 9,391,398 | B2 | 7/2016 | Omodachi et al. | |
| 9,590,327 | B2 * | 3/2017 | Matsuno | H01R 12/7005 |
| 9,647,361 | B2 | 5/2017 | Kobuchi et al. | |
| 9,666,963 | B2 * | 5/2017 | He | H01R 12/7088 |
| 9,985,366 | B2 * | 5/2018 | Takeuchi | H01R 12/707 |

FOREIGN PATENT DOCUMENTS

| | | | |
|---|---|---|---|
| JP | 2015-185541 | A | 10/2015 |
| JP | 2015-220005 | A | 12/2015 |
| JP | 2016-009619 | A | 1/2016 |
| JP | 2016-189244 | A | 11/2016 |
| JP | 2016-195056 | A | 11/2016 |
| JP | 2017-069133 | A | 4/2017 |

* cited by examiner

*Primary Examiner* — Hien D Vu

(74) *Attorney, Agent, or Firm* — Collard & Roe, P.C.

(57) ABSTRACT

Each of additional members of a connector is provided with a connection mechanism. The connection mechanism is provided with a spring portion and a plate piece portion. The plate piece portion has an end face. The end face is formed with a connection portion. The connection portion is oriented inward of the connector in a second direction and located in a receiving portion at least in part. The spring portion supports the plate piece portion so that the connection portion is moveable in the second direction. When the connector is mated with a mating connector, the connection portion is connected to a mating connection portion.

11 Claims, 12 Drawing Sheets

CONNECTOR

CROSS REFERENCE TO RELATED APPLICATIONS

This application is based on and claims priority under 35 U.S.C. § 119 to Japanese Patent Application No. JP2018-076172 filed Apr. 11, 2018, the contents of which are incorporated herein in their entireties by reference.

BACKGROUND OF THE INVENTION

This invention relates to a connector, in particular, to a stacking type connector.

Referring to FIG. 17, a connector assembly 90 disclosed in JP 2015-185541A (Patent Document 1) is provided with a receptacle connector 92 and a plug connector 94. The receptacle connector 92 and the plug connector 94 are mateable with and detachable from each other in a height direction (a Z-direction). The connector, which is mateable with and detachable from the mating connector along the height direction in this way, is called a stacking type connector. The stacking type connector is mounted on a circuit board to connect the circuit board to another circuit board, for example.

As shown in FIG. 17, the receptacle connector 92 is provided with receptacle metal fittings 920 at both ends thereof in a longitudinal direction. Referring to FIG. 18, each of the receptacle metal fittings 920 has protruding portions 922 to realize electrical connection to and mating lock with a plug metal fitting 940 (see FIG. 17). Each of the protruding portions 922 is formed on an inner side surface portion 924 of the receptacle metal fitting 920 by a cutting process and a pressing process.

In the receptacle metal fitting 920 of Patent Document 1, the inner side surface portion 924 exists around the protruding portion 922. This inner side surface portion 924 is necessary and essential to form the protruding portion 922 by the cutting process and the pressing process. Accordingly, the receptacle metal fitting 920 is hard to reduce a size thereof in the height direction (or a mating direction). Therefore, the receptacle connector 92 of Patent Document 1 has a problem that a size (or a height) thereof in the height direction is hard to be reduced.

SUMMARY OF THE INVENTION

It is therefore an object of the present invention to provide a connector of a stacking type that can reduce the size thereof in the height direction.

One aspect of the present invention provides a connector which is mountable on an object in an up-down direction and mateable with a mating connector having a mating connection portion. The connector comprises a housing, a plurality of terminals and two additional members. The housing is formed with a receiving portion which receives the mating connector at least in part in a mated state. The housing holds the terminals and the additional members. The additional members are located at both ends of the housing, respectively, in a first direction perpendicular to the up-down direction. Each of the additional members is provided with a connection mechanism. The connection mechanism is provided with a spring portion and a plate piece portion. The plate piece portion has an upper principal surface oriented upward in the up-down direction, a lower principal surface oriented downward in the up-down direction and an end face located between the upper principal surface and the lower principal surface in the up-down direction and oriented in a direction perpendicular to the up-down direction. The end face is provided with a connection portion which is connected to the mating connection portion when the connector and the mating connector are mated with each other. The connection portion is oriented inward of the connector in a second direction perpendicular to both of the up-down direction and the first direction and located in the receiving portion at least in part. In the connection mechanism, the spring portion supports the plate piece portion so as to allow the connection portion to move in the second direction.

In the connector of the present invention, the connection portion of the additional member is provided on the end face of the plate piece portion. Accordingly, there is no flat surface portion around the connection portion. Because of this, the present invention can provide the connector in which the height thereof is reduced.

An appreciation of the objectives of the present invention and a more complete understanding of its structure may be had by studying the following description of the preferred embodiment and by referring to the accompanying drawings.

Figure 1:
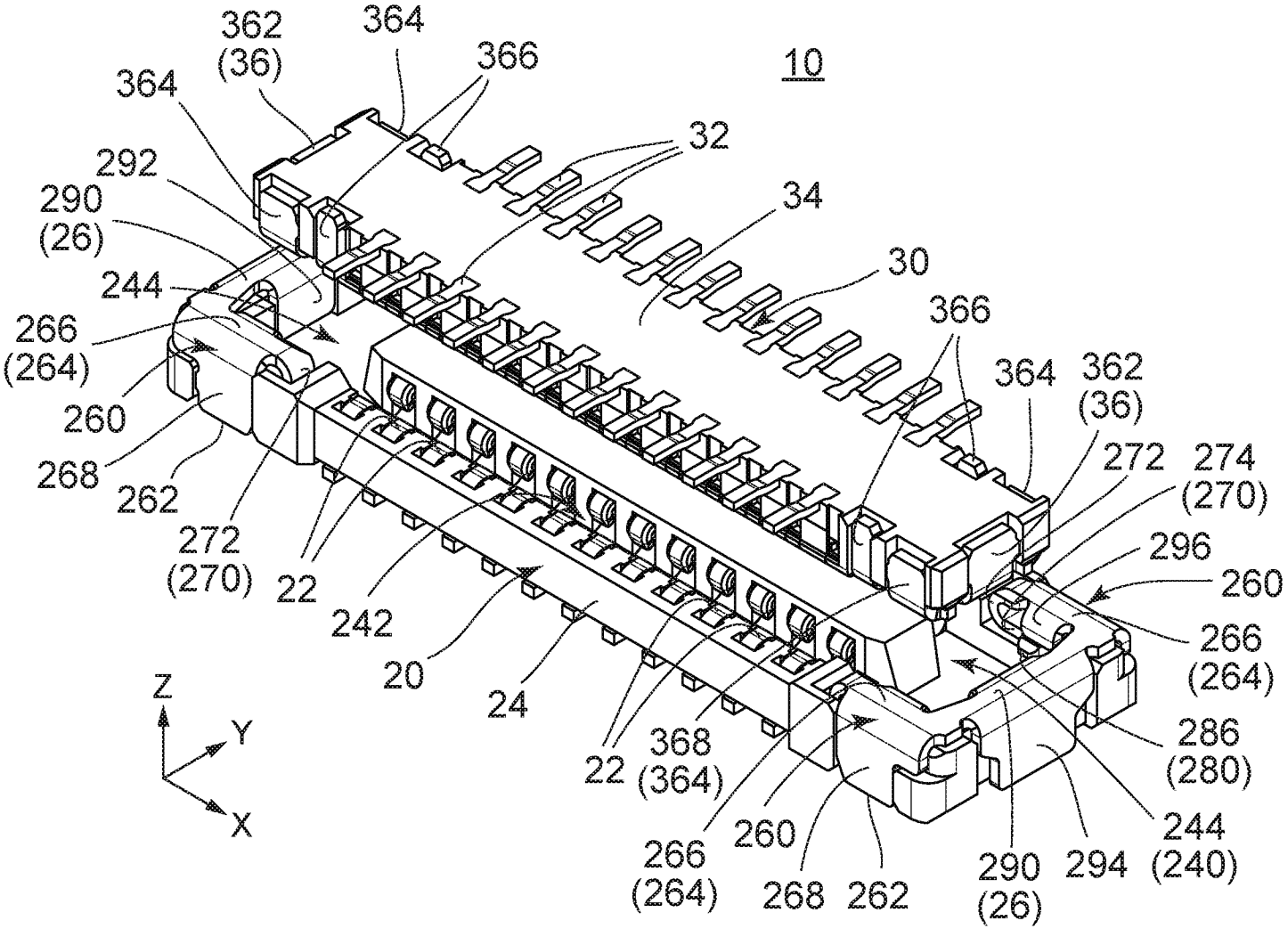
FIG. 1 is a perspective view showing a connector assembly according to a first embodiment of the present invention. A connector and a mating connector are not yet mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Referring to FIG. 1, a connector assembly 10 according to a first embodiment of the present invention is provided with a connector 20 and a mating connector 30. As understood from FIGS. 1 and 2, the connector 20 and the mating connector 30 are mateable with and detachable from each other along an up-down direction (or a height direction). In the present embodiment, the up-down direction is a Z-direction. A positive Z-direction is directed upward while a negative Z-direction is directed downward.

The connector 20 and the mating connector 30 are mounted on an object (not shown) and a mating object (not shown), respectively, when used. The object and the mating object are circuit boards, for example. In a case where the connector 20 is mounted on an upper surface of the object, the mating connector 30 is mounted on a lower surface of the mating object. The connector 20 and the mating connector 30 are mated with each other so that the upper surface of the object and the lower surface of the mating object face each other. Hence, the object and the mating object are connected to each other electrically and mechanically via the connector 20 and the mating connector 30.

Figure 5:
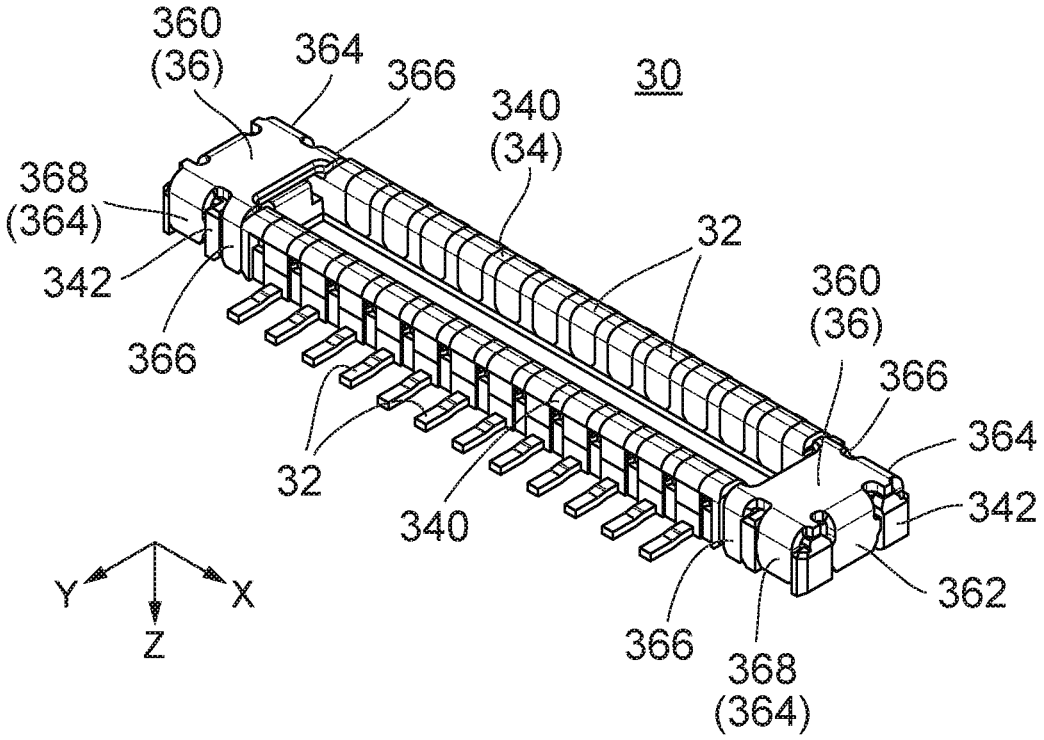
FIG. 5 is a perspective view showing the mating connector included in the connector assembly of FIG. 1.

Referring to FIG. 5, the mating connector 30 is provided with a plurality of mating terminals 32, a mating hosing 34 and a pair of mating fastening fittings 36. The mating terminals 32 are arranged in two rows along a first direction (a longitudinal direction) perpendicular to the up-down direction. The mating hosing 34 has a pair of long wall portions 340 long in the first direction and a pair of short wall portions 342. The short wall portions 342 are located at both ends of the long wall portions 340 in the first direction. The long wall portions 340 hold the mating terminals 32 separately. In addition, the short wall portions 342 hold the mating fastening fittings 36, respectively. In the present embodiment, the first direction is an X-direction.

As shown in FIG. 5, each of the mating fastening fittings 36 has a main portion 360, an end wall portion 362, a pair of first sidewall portions 364 and a pair of second sidewall portions 366. The mating fastening fitting 36 is formed by applying a cutting process and a bending (or a pressing process) to a metal plate. The main portion 360 has an approximately rectangular flat plate shape and covers a lower surface of the mating hosing 34 in part. The end wall portion 362 extends upward from one of edges of the main portion 360 in the first direction and covers an end face of the mating hosing 34 in part. The first sidewall portions 364 and the second sidewall portions 366 extend upward from edges of the main portion 360 in a second direction (a lateral direction) and cover side surfaces of the mating hosing 34 in part. In the present embodiment, the second direction is a direction perpendicular to both of the up-down direction and the first direction, or it is a Y-direction. The second sidewall portions 366 are located inward of the first sidewall portions 364 in the first direction. The end wall portion 362 is provided with press-fit protrusions protruding outward in the second direction. In addition, the first sidewall portions 364 are provided with press-fit protrusions protruding inward in the first direction. Using these press-fit protrusions, the mating fastening fitting 36 is fixed to the mating hosing 34.

As shown in FIG. 5, each of the first sidewall portions 364 has a principal surface 368 perpendicular to the second direction. The principal surface 368 of the first sidewall portion 364 works as a mating connection portion to be connected to a connection portion 286 (see FIG. 6 and others) of the connector 20 mentioned later. Thus, the mating connector 30 has the mating connection portions 368.

Figure 6:
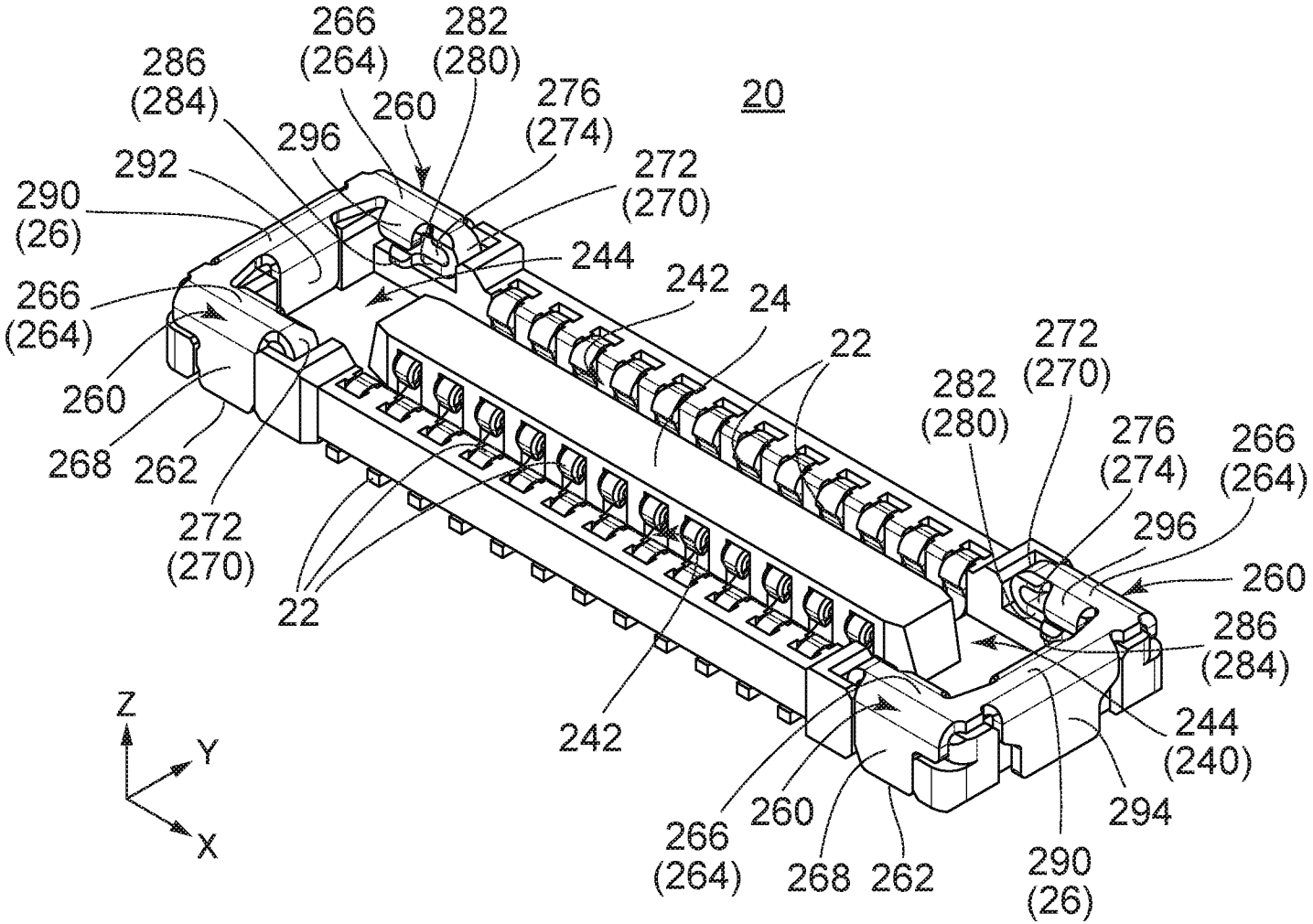
FIG. 6 is a perspective view showing the connector included in the connector assembly of FIG. 1.
Figure 7:
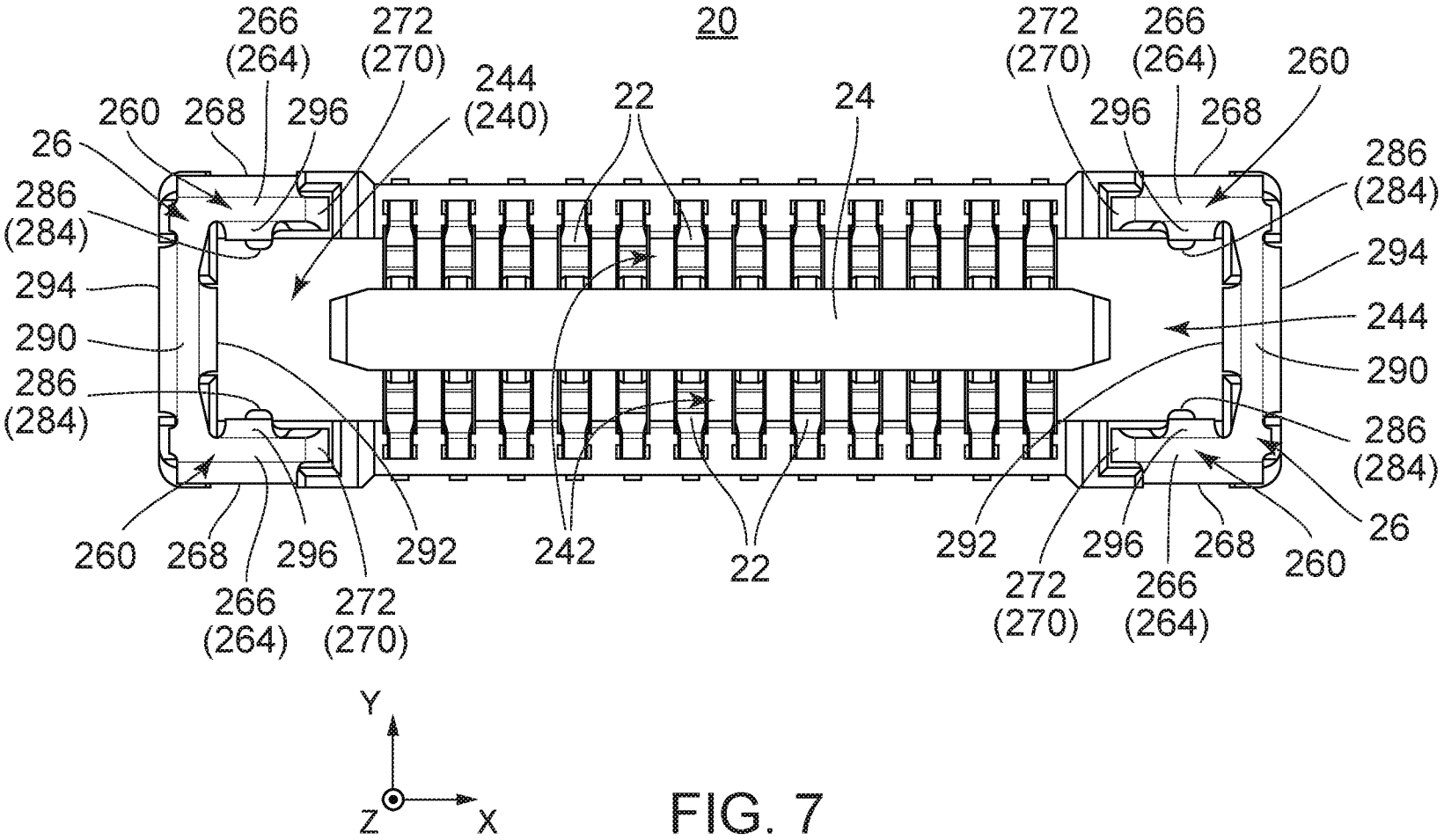
FIG. 7 is a plan view showing the connector of FIG. 6.

Referring to FIGS. 6 and 7, the connector 20 is provided with a plurality of terminals 22, a housing 24 and a pair of fastening fittings (additional members) 26. The terminals 22 are arranged in two rows along the first direction. The housing 24 holds the terminals 22 and the fastening fittings 26. The housing 24 is formed with a receiving portion 240 which receives the mating connector 30 at least in part when the connector 20 and the mating connector 30 are mated with each other. As understood from FIG. 7, a shape of the receiving portion 240 is an approximately frame shape when viewed along the up-down direction. In detail, the receiving portion 240 is formed of two of long grooves 242 and two of short grooves 244 connecting end portions of the long grooves 242 to one another. The long grooves 242 correspond to the long wall portions 340 (see FIG. 5) of the mating connector 30 while the short grooves 244 correspond to the short wall portions 342 (see FIG. 5) of the mating connector 30. Each of the terminals 22 protrudes into the receiving portion 240 in part. In detail, each of the terminals 22 has two of contact points protruding into any one of the long grooves 242. Two of the contact points of the terminal 22 are opposite to each other in the second direction. The fastening fittings 26 are located at both ends of the mating hosing 34 in the first direction. Each of the fastening fittings 26 also protrudes into the receiving portion 240 in part.

Referring to FIGS. 8 to 13, each of the fastening fittings 26 has a pair of main portions 260 and a coupling portion 290. Each of the main portions 260 is provided with a fixed portion 262, a base portion 264 and a connection mechanism 270. The connection mechanism 270 is provided with a spring portion 272 and a plate piece portion 274. Thus, each of the main portions 260 is provided with the fixed portion 262, the base portion 264, the spring portion 272 and the plate piece portion 274. The main portions 260 of the fastening fitting 26 are located to sandwich any one of the short grooves 244 (see FIG. 7) of the receiving portion 240 in the second direction. The coupling portion 290 of the fastening fitting 26 extends in the second direction to connect the base portions 264 of the main portions 260 to each other. Each of the fastening fittings 26 is formed by applying a cutting process and a bending process to a metal plate.

Figure 8:
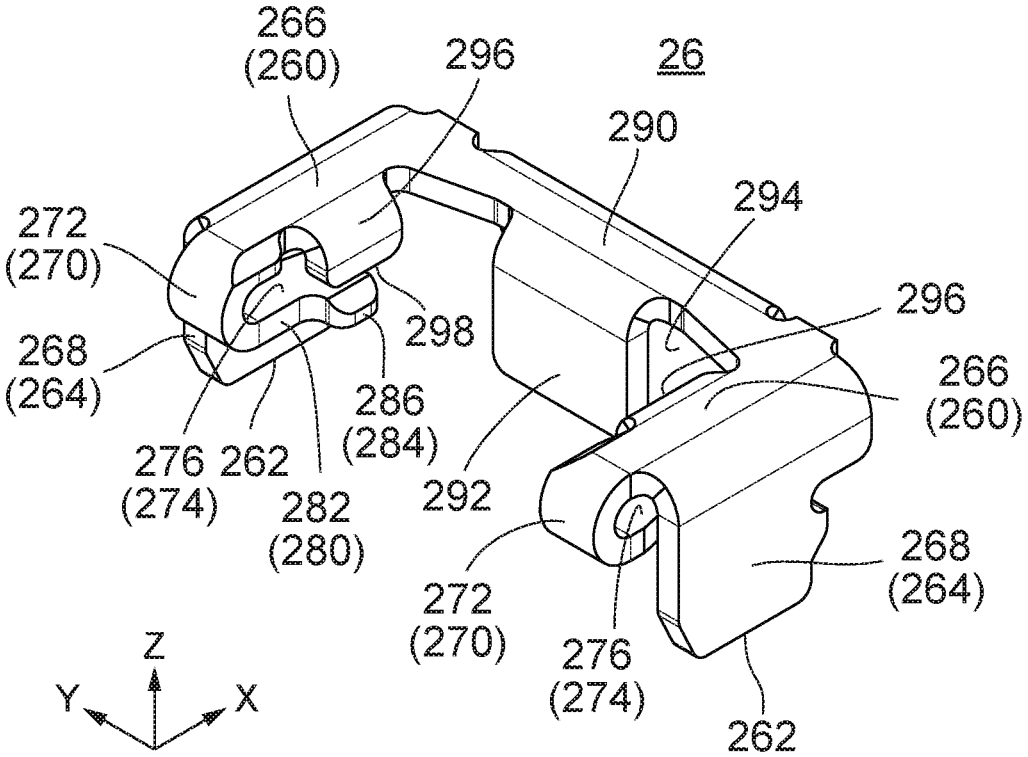
FIG. 8 is a perspective view showing an additional member included in the connector of FIG. 6.
Figure 9:
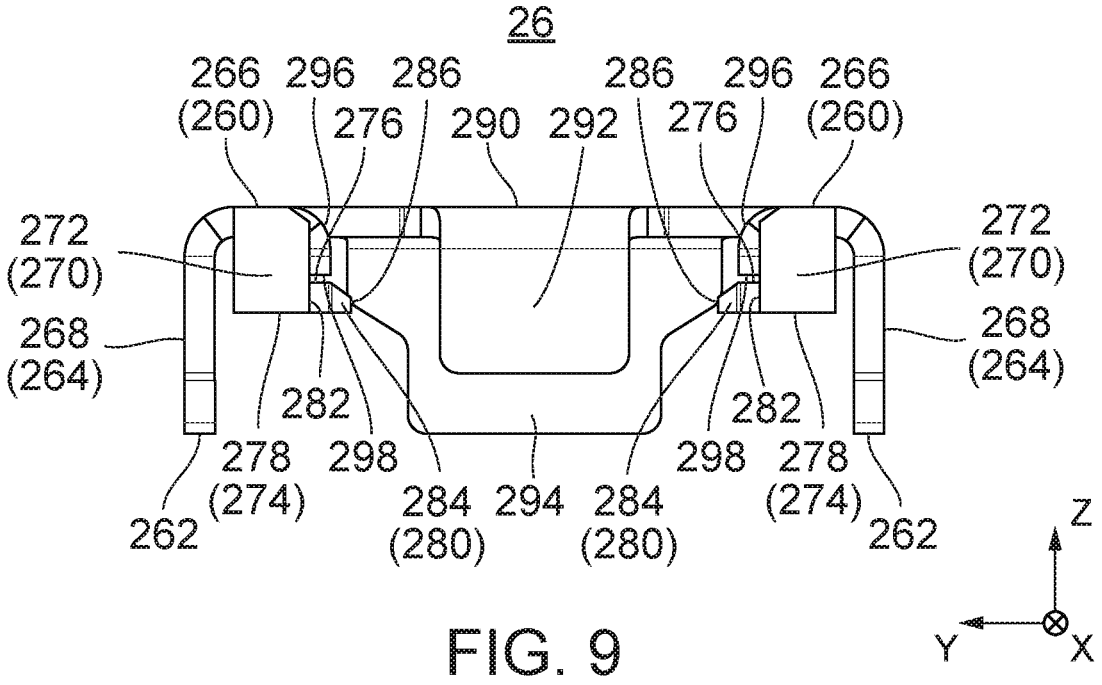
FIG. 9 is a front view showing the additional member of FIG. 8.
Figure 10:
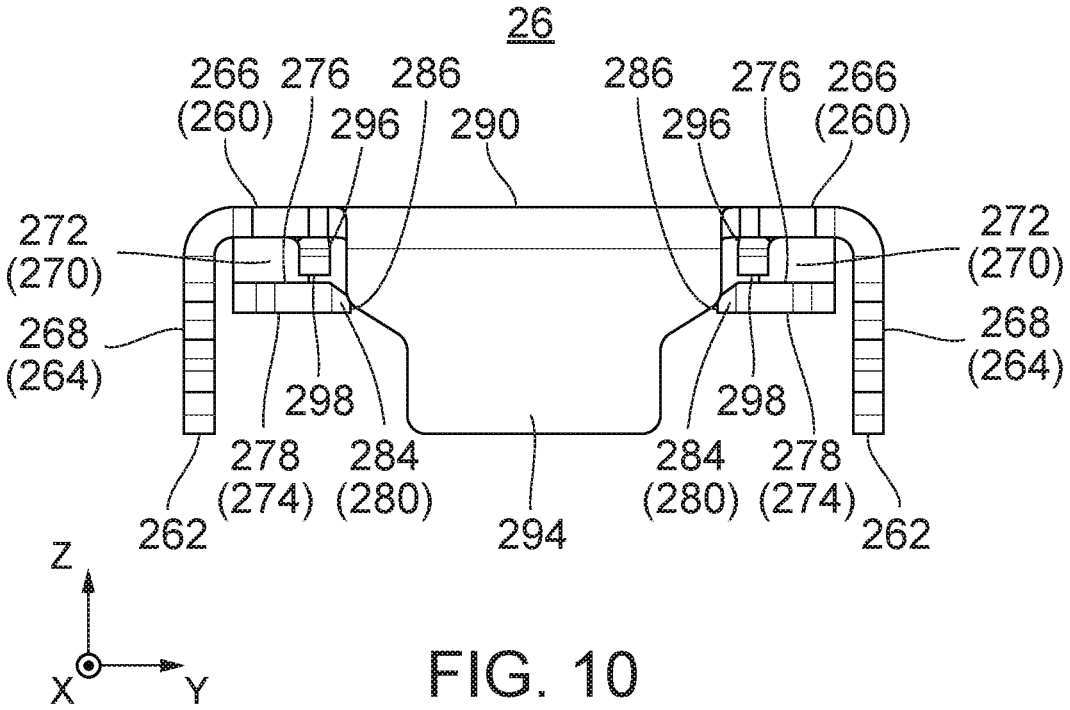
FIG. 10 is a rear view showing the additional member of FIG. 8.
Figure 11:
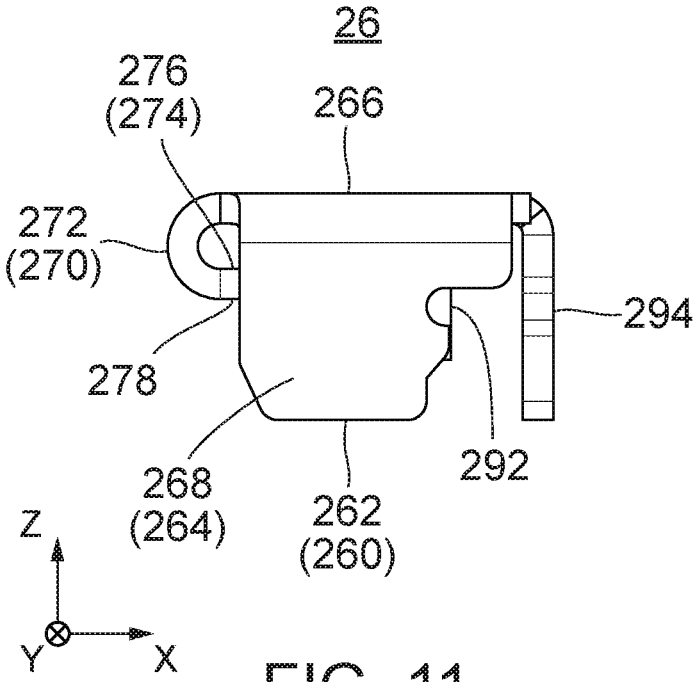
FIG. 11 is a right-side view showing the additional member of FIG. 8.

As understood from FIGS. 8 to 13, the base portions 264 of the fastening fitting 26 are apart from each other in the second direction. As shown in FIGS. 8 to 13, each of the base portions 264 is provided with an upper wall portion 266 and a sidewall portion 268. A lower end of the sidewall portion 268 forms the fixed portion 262. The fixed portion 262 is a part to which an object (not shown) is connected when the connector 20 is mounted on the object. The sidewall portion 268 extends upward from the fixed portion 262. The sidewall portion 268 leads to an outer edge of the upper wall portion 266 in the second direction. The upper wall portion 266 extends from the sidewall portion 268 in a direction intersecting with the up-down direction. As shown in FIG. 6, the upper wall portion 266 covers an upper surface of the housing 24 in part, and the sidewall portion 268 covers a side surface of the housing 24 in part. As shown in FIGS. 8 and 11, the sidewall portion 268 is provided with a press-fit protrusion protruding in one direction along the first direction. As understood form FIG. 3, each of the fastening fittings 26 is fixed to the housing 24 by the press-fit protrusions of the sidewall portions 268.

As understood from FIGS. 8 to 13, the plate piece portion 274 has an upper principal surface 276, a lower principal surface 278 and an end face 280. The upper principal surface 276 is a surface oriented upward in the up-down direction. The lower principal surface 278 is a surface oriented downward in the up-down direction. The upper principal surface 276 and the lower principal surface 278 may be perpendicular to or intersects with the up-down direction. For example, the upper principal surface 276 and the lower principal surface 278 may be inclined at 15 degrees or less with respect to the up-down direction. In the present embodiment, both of the upper principal surface 276 and the lower principal surface 278 are perpendicular to the up-down direction. In other words, the plate piece portion 274 is disposed so that a thickness direction thereof is parallel to the up-down direction.

Figure 12:
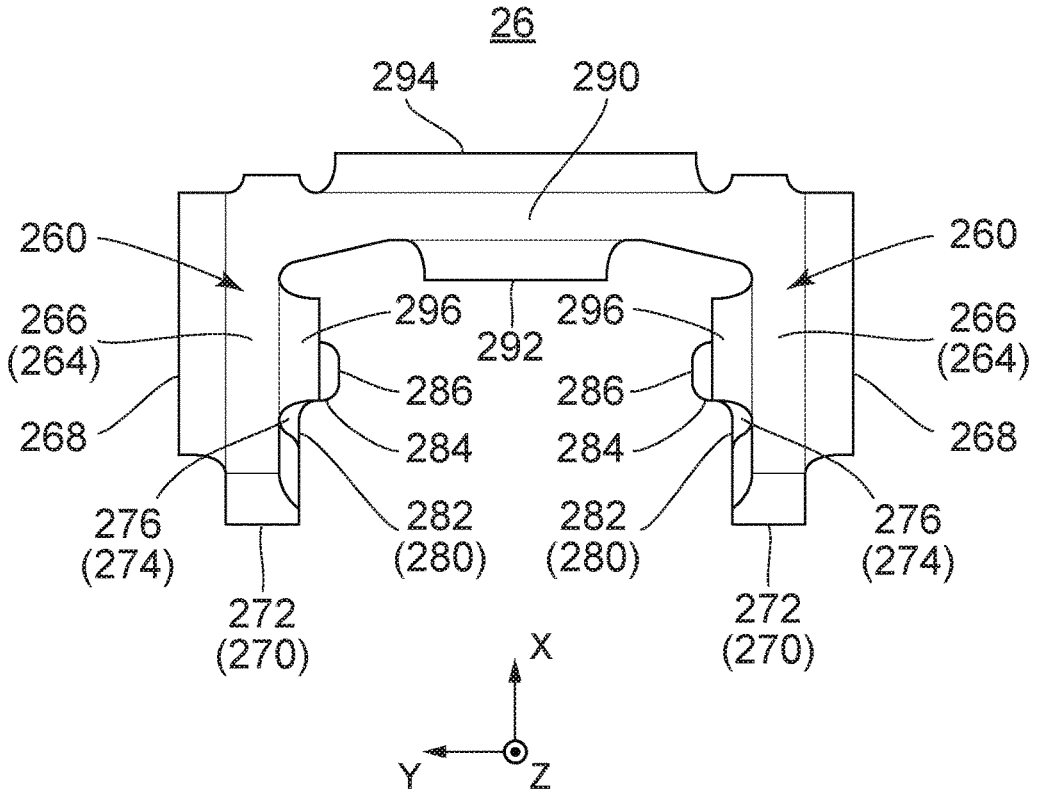
FIG. 12 is a plan view showing the additional member of FIG. 8.
Figure 13:
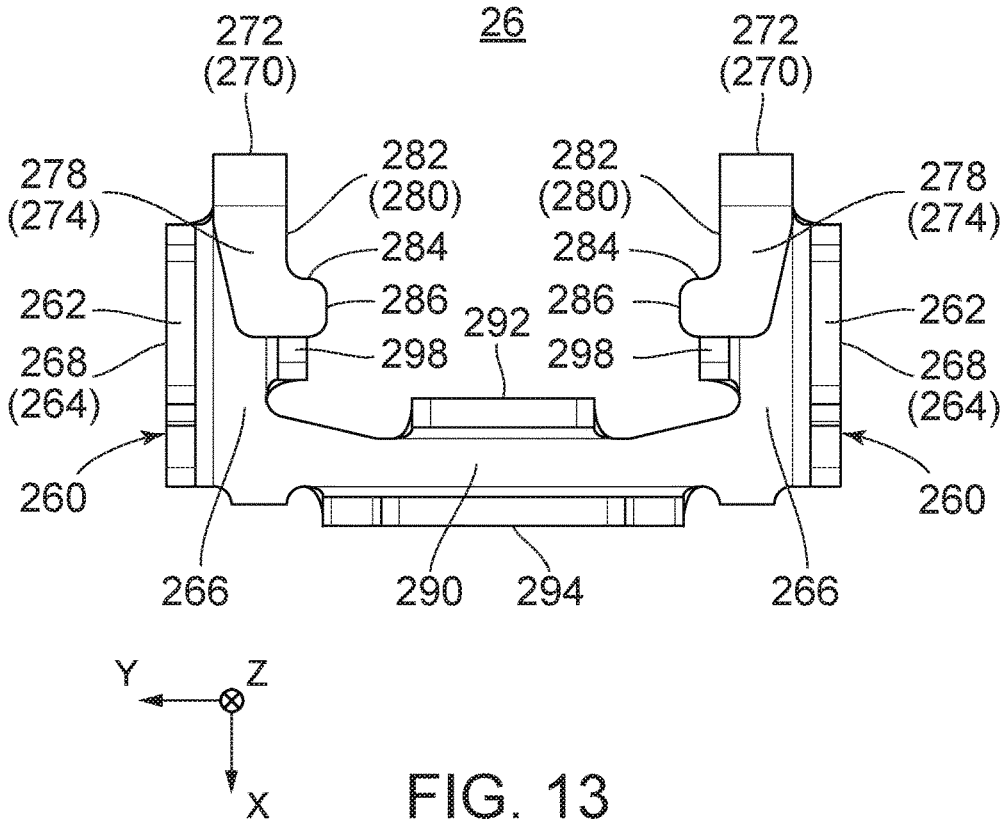
FIG. 13 is a bottom view showing the additional member of FIG. 8.

As understood from FIGS. 8 to 13, the end face 280 is located between the upper principal surface 276 and the lower principal surface 278 in the up-down direction and perpendicular to both of the upper principal surface 276 and the lower principal surface 278. In the present embodiment, the end face 280 is a surface oriented to a direction perpendicular to the up-down direction. The end face 280 may be inclined with respect to the direction perpendicular to the up-down direction according to inclination of the upper principal surface 276 and the lower principal surface 278. The end face 280 may be one or more flat surfaces or a curved surface. Alternatively, the end face 280 may be a combination of one or more flat surfaces and one or more curved surfaces. In the present embodiment, the plate piece portion 274 has a boot-like shape as shown in FIG. 13 when viewed along the up-down direction. The end face 280 also has a boot-like shape when viewed along the up-down direction. Accordingly, in the present embodiment, the end face 280 is formed of a plurality of flat surfaces and a plurality of curved surfaces.

Particularly, as understood from FIG. 13, the end face 280 has an inner side surface 282 and a protruding surface 284 contiguous to the inner side surface 282. The inner side surface 282 intersects with the second direction and is oriented inward in the second direction. The protruding surface 284 protrudes inward of the connector 20 from the inner side surface 282 in the second direction. The protruding surface 284 corresponds to a toe portion of the boot-like shape. As understood from FIG. 7, the protruding surface 284 is located in one of the short grooves 244 of the receiving portion 240 at least in part. Particularly, a tip end surface 286 of the protruding surface 284 is located in the short groove 244 of the receiving portion 240 and oriented inward of the connector 20 in the second direction. The tip end surface 286 is visible at least in part when the fastening fitting 26 is viewed along the up-down direction. In this embodiment, an outline (an edge) of the tip end surface 286 is visible. The tip end surface 286 of the protruding surface 284 works as the connection portion to be connected to the mating connection portions 368 (see FIG. 5) when the connector 20 and the mating connector 30 (see FIG. 5) are mated with each other. In other words, the protruding surface 284 is formed with the connection portion 286. However, the present invention is not limited thereto. In the present invention, it is enough that the connection portion is provided on the end face 280 so as to be located in the receiving portion 240 at least in part and oriented inward of the connector 20 in the second direction. In other words, it is enough that a part of the end face 280 is located in the receiving portion 240 and oriented inward of the connector 20 in the second direction so as to work as the connection portion. For example, the connection portion is not limited to the flat surface, and it may be a curved surface, a convex surface or a ridge formed by flat surfaces adjacent to each other. Alternatively, in a case where a shape of the plate piece portion 274 is a quadrilateral when viewed along the up-down direction, a side or an edge thereof may be used as the connection portion.

As understood from FIGS. 8 to 11, the spring portion 272 has a U-shape when viewed along the second direction. In detail, the spring portion 272 extends in one direction along the first direction from the upper wall portion 266 of the base portion 264, is bent downward, and further extends an opposite direction along the first direction. The spring portion 272 links, to the plate piece portion 274, the upper wall portion 266 of the base portion 264 corresponding thereto. The spring portion 272 has resilience and supports the plate piece portion 274 so as to be movable with respect to the upper wall portion 266. In detail, as understood from FIGS. 8 to 11, the spring portion 272 supports the plate piece portion 274 so that the tip end surface (the connection portion) 286 of the protruding surface 284 of the plate piece portion 274 is movable at least in the second direction. As understood from FIGS. 8 to 13, the plate piece portion 274 supported by the spring portion 272 is located below the upper wall portion 266 in the up-down direction. As shown in FIG. 12, the plate piece portion 274 is hidden by the upper wall portion 266 at least in part when viewed from above in the up-down direction. In the present embodiment, the upper wall portion 266 and the plate piece portion 274 are disposed in parallel with each other. However, the present invention is limited thereto. The upper wall portion 266 and the plate piece portion 274 are not parallel with each other.

As shown in FIGS. 8 to 13, the coupling portion 290 is provided with an inner wall portion 292 and an outer wall portion 294 which extend downward. As shown in FIG. 6, the inner wall portion 292 is located inward of the connector 20 in the first direction while the outer wall portion 294 is located outward of the connector 20 in the first direction. Sandwiching a part of the housing 24 between the inner wall portion 292 and the outer wall portion 294 prevents the fastening fitting 26 from being moved along the first direction with respect to the housing 24.

As shown in FIGS. 8 to 10, 12 and 13, the fastening fitting 26 according to the present embodiment is further provided with a pair of guide portions 296 and a pair of regulating portions 298.

As shown in FIGS. 8, 9 and 12, the guide portions 296 are located inward of the upper wall portions 266 in the second direction. The guide portions 296 extend from the upper wall portions 266 inward in the second direction and downward in the up-down direction. Although each of the guide portions 296 has a curved surface in the present embodiment, it may have a flat surface instead of the curved surface.

As understood from FIGS. 8 to 10, the regulating portions 298 are located upward of the upper principal surfaces 276 of the plate piece portions 274. In the present embodiment, the regulating portions 298 are lower end faces of the guide portions 296 and located upward of the upper principal surfaces 276 in part. However, the present invention is not limited thereto. The regulating portions 298 may be provided to the upper wall portions 266 separately from the guide portions 296. The regulating portions 298 are located near the upper principal surfaces 276 to regulate upward movement of the upper principal surfaces 276. With this arrangement, the regulating portions 298 prevent excessive deformation of the connection mechanisms 270.

Figure 2:
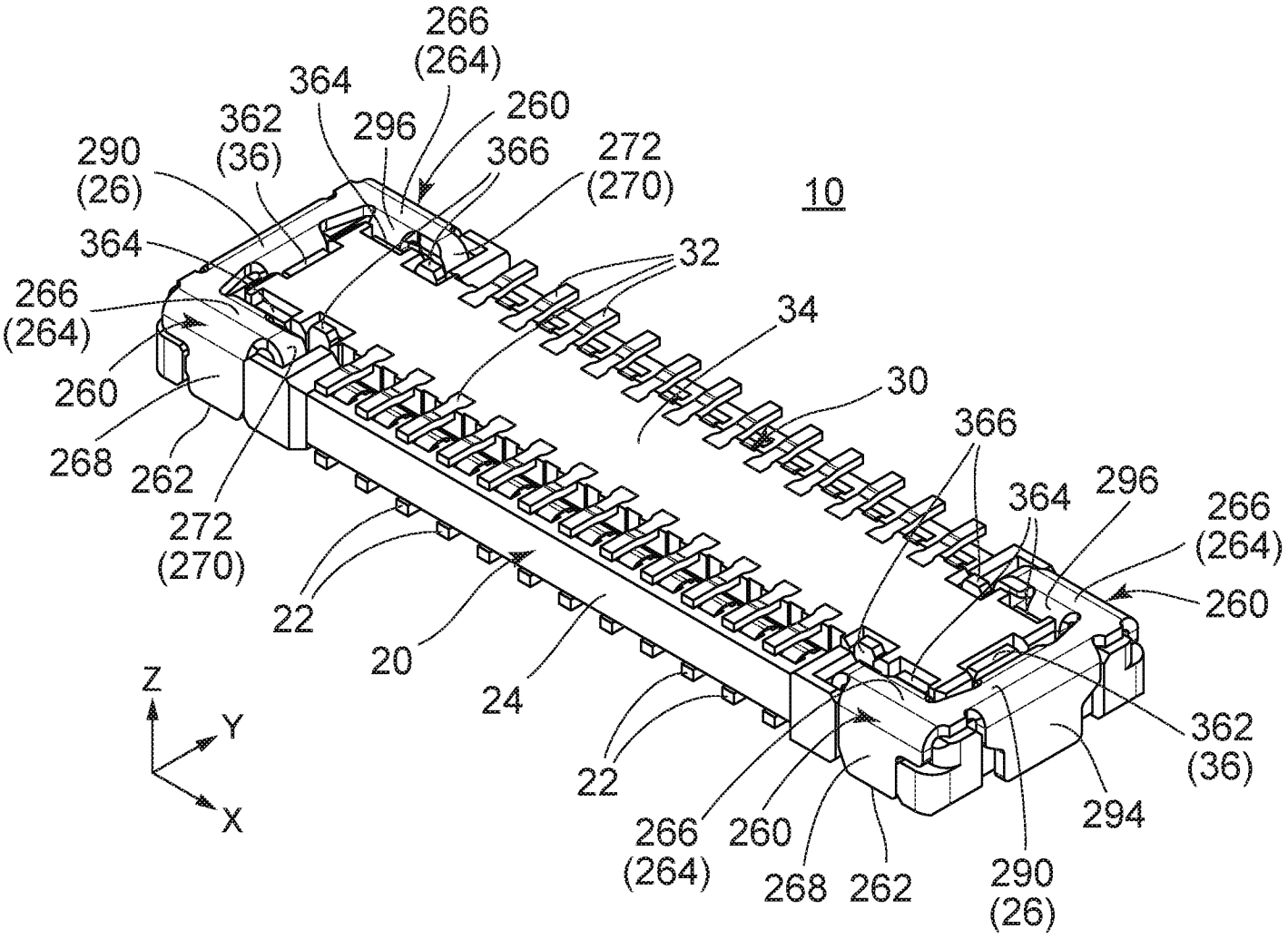
FIG. 2 is another perspective view showing the connector assembly of FIG. 1. The connector and the mating connector are mated with each other.

As understood from FIGS. 1 and 2, the mating connector 30 is inserted into the receiving portion 240 of the connector 20 from above the connector 20. At this time, the guide portions 296 guide the mating connector 30 to the receiving portion 240. In other words, the guide portions 296 carry out positioning of the mating connector 30 with respect to the second direction.

Figure 3:
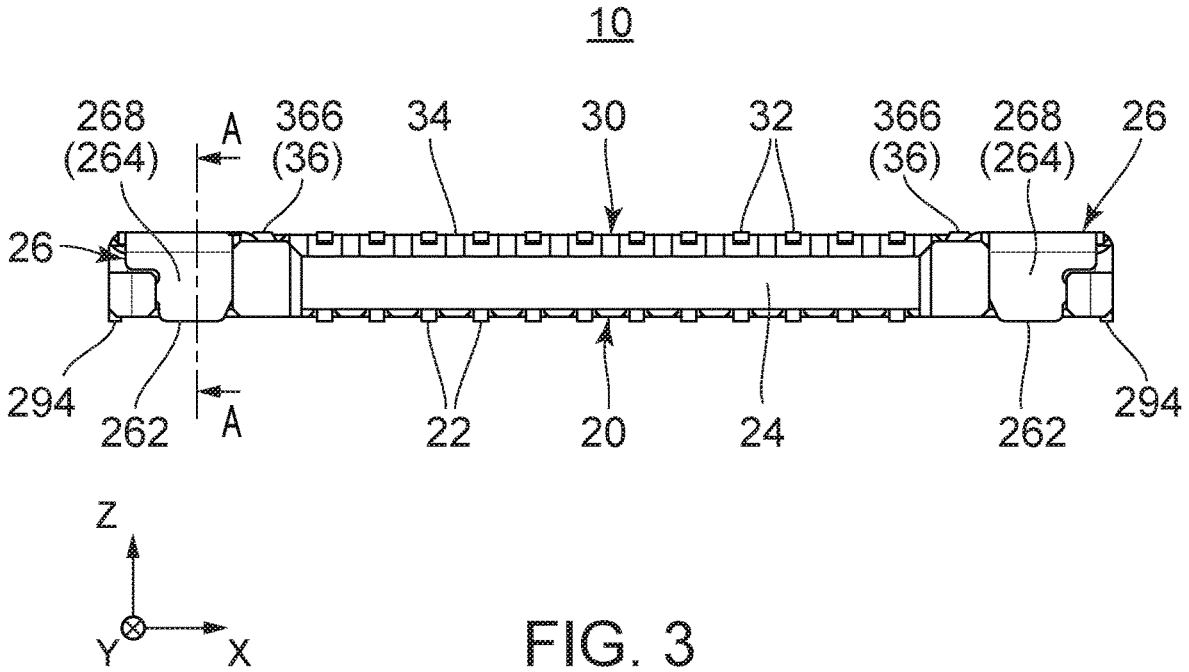
FIG. 3 is a side view showing the connector assembly of FIG. 2.
Figure 4:
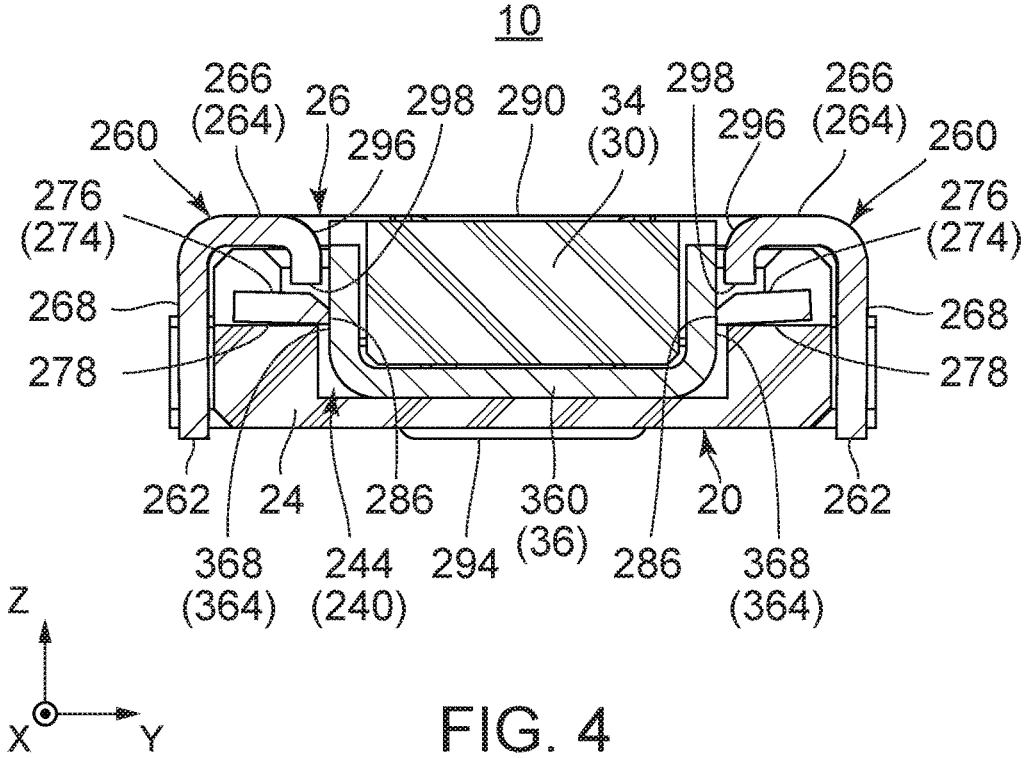
FIG. 4 is a cross-sectional view showing the connector assembly of FIG. 3, taken along line A-A.

Referring to FIGS. 3 and 4, in a state that the connector 20 and the mating connector 30 are mated with each other, the tip end surfaces (the connection portions) 286 of each of the fastening fittings 26 and the principal surfaces (the mating connection portions) 368 of each of the mating fastening fittings 36 are connected to each other. To achieve this, in a state that the connector 20 and the mating connector 30 are not mated with each other, an interval between the tip end surfaces 286 of the fastening fitting 26 is narrower than a width of the mating fastening fitting 36 in the second direction. When the mating connector 30 is received in the receiving portion 240 of the connector 20, the plate piece portions 274 of the fastening fitting 26 are pushed outward in the second direction by the mating fastening fitting 36. At this time, because of the resilience of the spring portions 272 (see FIG. 1), the interval between the plate piece portions 274 of the fastening fitting 26 are broadened. As a result, the mating connector 30 is received by the receiving portion 240 of the connector 20. Then, because of restoring forces of the spring portions 272, the tip end surfaces (the connection portions) 286 are pressed against the principal surfaces (the mating connection portions) 368. In this manner, the tip end surfaces (the connection portions) 286 of the fastening fitting 26 and the principal surfaces (the mating connection portions) 368 of the mating fastening fitting 36 are connected to each other. Especially, in the present specification, "connected" means at least one of an electrical connection and a mechanical connection. In the present embodiment, "connected" means the electrical connection mainly. In detail, in the present embodiment, the connection portions 286 and the mating connection portions 368 are electrically connected to each other by bringing into contact with each other.

As mentioned above, in the connector 20 according to the present embodiment, the connection portion 286 is provided on the end face 280 (see FIG. 8) of the plate piece portion 274. Accordingly, no flat surface portion is necessary around the connection portion 286. Therefore, the connection mechanism 270 including the connection portions 286 can be reduced in height, and thereby the connector 20 can be also reduced in height.

Second Embodiment

Figure 14:
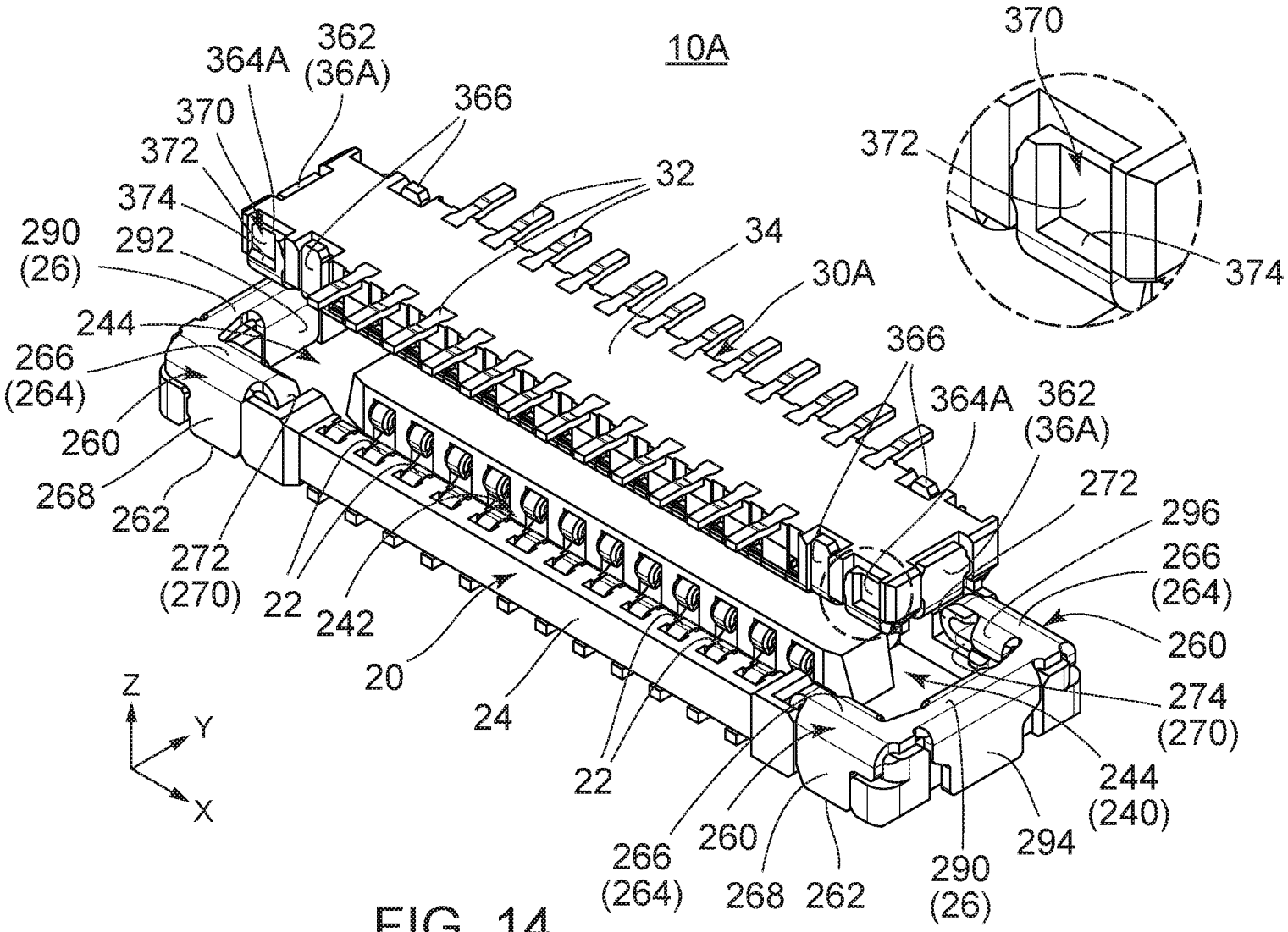
FIG. 14 is a perspective view showing a connector assembly according a second embodiment of the present invention. A connector and a mating connector are not yet mated with each other.

Referring to FIG. 14, a connector assembly 10A according to a second embodiment of the present invention is provided with a connector 20 and a mating connector 30A. The connector 20 has the same structure as that of the connector 20 of the connector assembly 10 (see FIG. 1) according to the first embodiment. The mating connector 30A is different from the mating connector 30 (see FIG. 1) of the connector assembly 10 according to the first embodiment in a point that each of mating fastening fittings 36A has recess portions 370.

As shown in FIG. 14, the recess portions 370 are formed in first sidewall portions 364A, respectively. The recess portions 370 are dented inward of the mating connector 30A in the second direction. In the present embodiment, each of the recess portions 370 is defined by a bottom surface 372 and two sidewalls. However, the present invention is not limited thereto. For example, the recess portion 370 may be surrounded from every direction by sidewalls. The recess portion 370 has a size capable of receiving the protruding surface 284 (see FIG. 8) at least in part when the connector 20 and the mating connector 30A are mated with each other. The sidewall located at a lower side among the sidewalls defining the recess portion 370 has a side surface 374. The side surface 374 works as a locked surface (mating connection portion) to lock a mated state between the connector 20 and the mating connector 30A.

Figure 15:
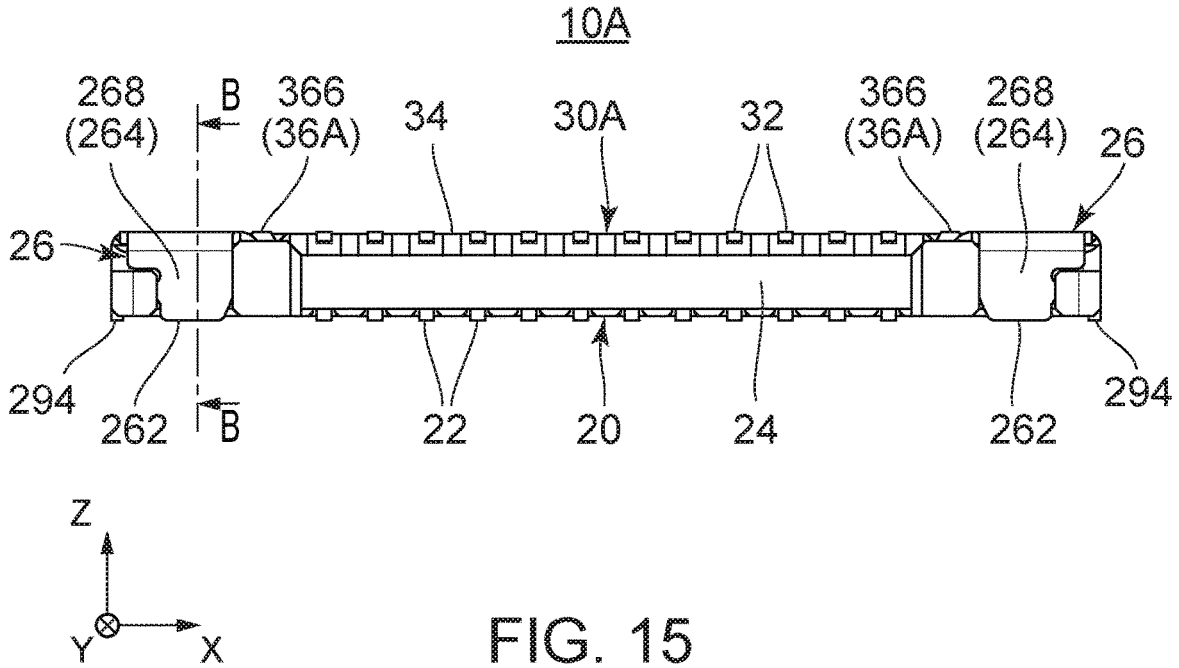
FIG. 15 is a side view showing the connector assembly of FIG. 14. The connector and the mating connector are mated with each other.
Figure 16:
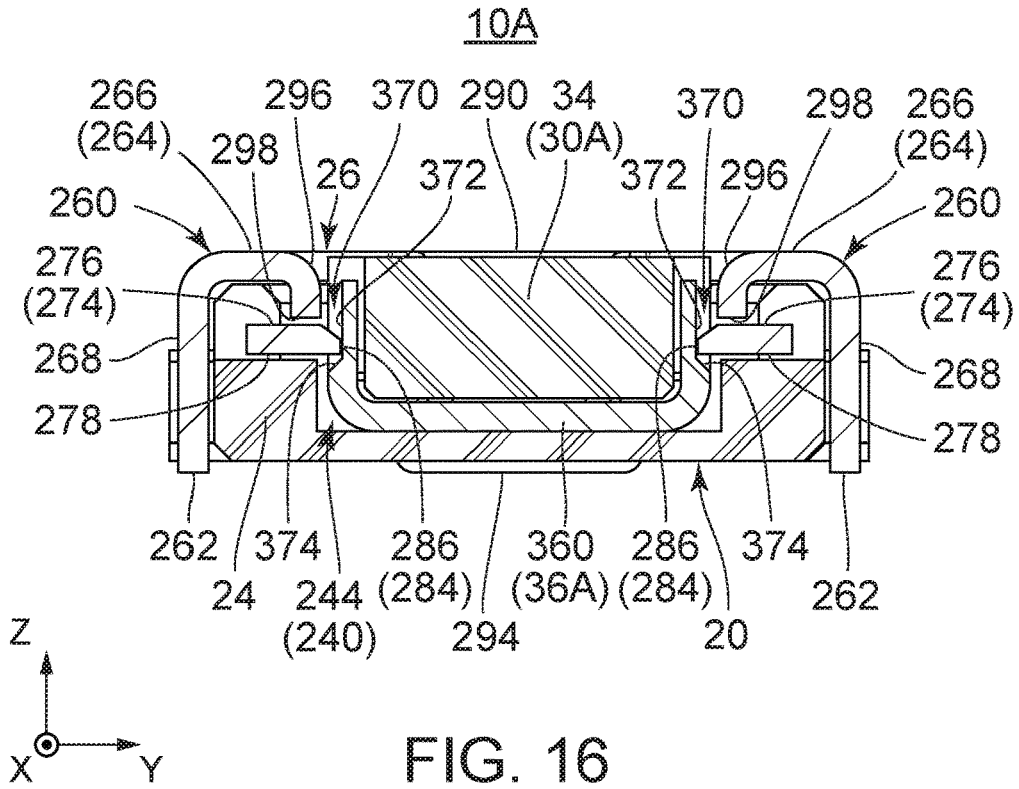
FIG. 16 is a cross-sectional view showing the connector assembly of FIG. 15, taken along line B-B.
Figure 17:
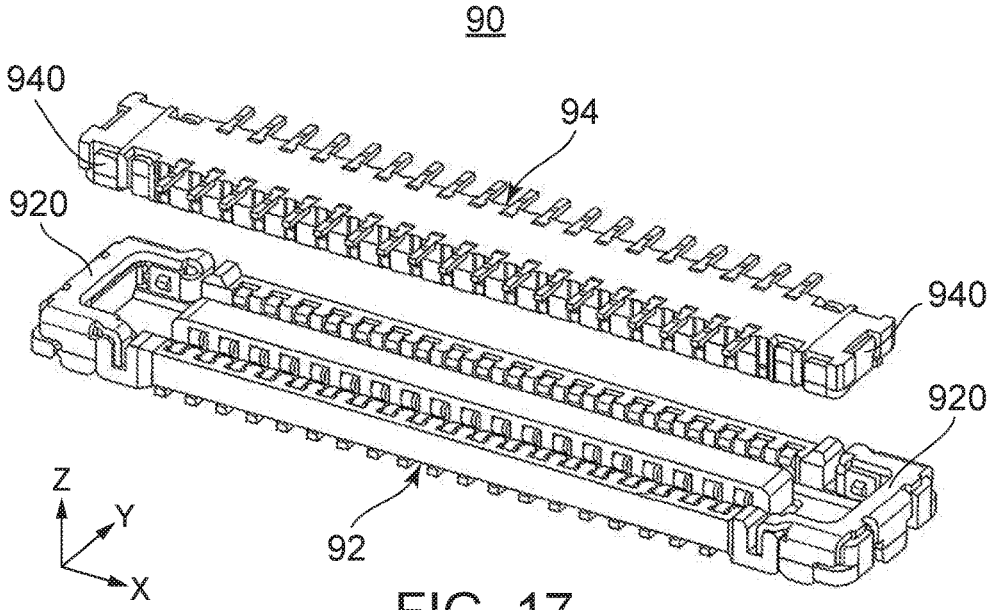
FIG. 17 PRIOR ART
FIG. 17 is a perspective view showing a connector assembly disclosed in Patent Document 1.
Figure 18:
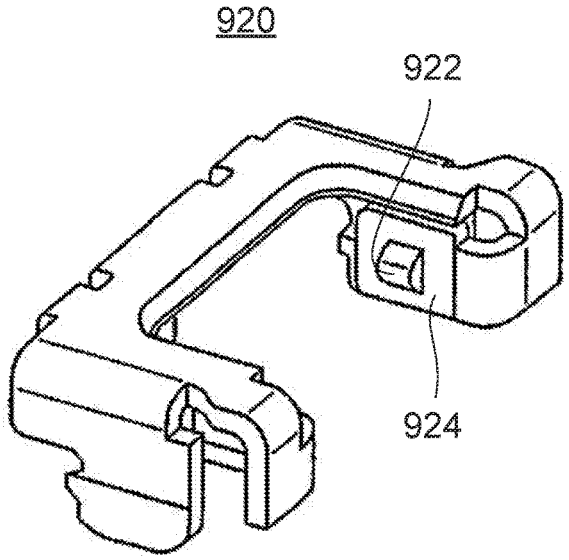
FIG. 18 PRIOR ART
FIG. 18 is a perspective view showing a receptacle metal fitting of a receptacle connector included in the connector assembly of FIG. 17.

Referring to FIGS. 15 and 16, in the state that the connector 20 and the mating connector 30A are mated with each other, the tip end surfaces (the connection portions) 286 of each of the fastening fittings 26 and the locked surfaces (the mating connection portions) 374 of each of the mating fastening fittings 36A are connected to each other. In detail, each of the tip end surfaces 286 is located in the recess portion 370 corresponding thereto at least in part and located upward of the locked surface 374 of the recess portion 370 in the up-down direction. In other words, each of the locked surfaces 374 is located below the protruding surface 284 corresponding thereto at least in part. When the mating connector 30A is tried to be moved in a direction detaching from the connector 20 from this state, the locked surface 374 is brought into abutment with a part of the tip end surface 286. In this manner, the mated state between the connector 20 and the mating connector 30A is locked. In other words, the tip end surfaces (the connection portions) 286 and the locked surfaces (the mating connection portions) 374 are mechanically connected to each other, and the state is maintained.

As shown in FIG. 16, in the present embodiment, when the connector 20 and the mating connector 30A are mated with each other, the tip end surfaces 286 are brought into contact with the bottom surfaces 372 of the recess portions 370. In other words, the fastening fitting 26 and the mating fastening fitting 36 are electrically connected to each other. However, if it is unnecessary that the fastening fitting 26 and the mating fastening fitting 36 are electrically connected to each other, the tip end surfaces 286 may be apart from the bottom surfaces 372 of the recess portions 370. In that case, the tip end surfaces (the connection portions) 286 and the locked surfaces (the mating connection portions) 374 are maintained in the state that they are mechanically connected to each other. Thus, mechanically "connected" in the present embodiment may not always accompany physical contact.

As shown in FIG. 16, in the present embodiment, when the connector 20 and the mating connector 30A are mated with each other, the tip end surfaces 286 are apart from the locked surfaces 374 in the up-down direction. However, the present invention is not limited thereto. The tip end surfaces 286 may be brought into contact with the locked surfaces 374 at least in part. In that case, the tip end surfaces 286 and the locked surfaces 374 are connected to each other not only mechanically but electrically.

As understood from FIG. 16, the locked surfaces 374 are diagonally intersected with the up-down direction. Accordingly, when the mating connector 30A is moved upward with respect to the connector 20, the locked surfaces 374 are brought into abutment with the plate piece portions 274, and the plate piece portions 274 receive forces directed outward in the second direction. When the tip end surfaces 286 are moved outward in the second direction by resilient deformation of the spring portions 272 (see FIG. 8), the lock of the mated state between the connector 20 and the mating connector 30A is released. In this manner, the mating connector 30A can be detached from the connector 20.

The connector 20 according to the present embodiment can be also reduced in height as mentioned about the first embodiment. In addition, even when the connector 20 is reduced in height, as mentioned above, the connection portions 286 thereof can be mechanically connected to the locked surfaces 374 of the mating connector 30A.

While there has been described what is believed to be the preferred embodiment of the invention, those skilled in the art will recognize that other and further modifications may be made thereto without departing from the spirit of the invention, and it is intended to claim all such embodiments that fall within the true scope of the invention. For example, although the coupling portion 290 couples the base portions 264 to each other in the embodiment mentioned above, it may couple the guide portions 296 to each other. Alternately, the coupling portion 290 may couple the base portions 264 to each other and couple the guide portions 296 to each other. Moreover, although each of the additional members 26 has the guide portions 296, it may not have the guide portions 296. Furthermore, each of the additional members 26 may not have the regulating portions 298.

What is claimed is:

1. A connector which is mountable on an object in an up-down direction and mateable with a mating connector having a mating connection portion, wherein:

the connector comprises a housing, a plurality of terminals and two additional members;

the housing is formed with a receiving portion which receives the mating connector at least in part in a mated state;

the housing holds the terminals and the additional members;

the additional members are located at both ends of the housing, respectively, in a first direction perpendicular to the up-down direction;

each of the additional members is provided with a connection mechanism;

the connection mechanism is provided with a spring portion and a plate piece portion;

the plate piece portion has an upper principal surface oriented upward in the up-down direction, a lower principal surface oriented downward in the up-down direction and an end face located between the upper principal surface and the lower principal surface in the up-down direction and oriented in a direction perpendicular to the up-down direction;

the end face is provided with a connection portion which is connected to the mating connection portion when the connector and the mating connector are mated with each other;

the connection portion is oriented inward of the connector in a second direction perpendicular to both of the up-down direction and the first direction and located in the receiving portion at least in part;

in the connection mechanism, the spring portion supports the plate piece portion so as to allow the connection portion to move outward in the second direction when the mating connector is received in the receiving portion of the connector and inward in the second direction when the connection portion is pressed against the mating connection portion;

each of the additional members has an upper wall portion;

the spring portion extends from the upper wall portion;

the plate piece portion is located downward of the upper wall portion; and the plate piece portion is hidden by the upper wall portion at least in part when viewed from above in the up-down direction.

2. The connector as recited in claim 1, wherein:

each of the additional members has a fixed portion and a base portion;

the fixed portion is a part which is fixed to the object when the connector is mounted on the object;

the base portion has a sidewall portion extending upward from the fixed portion in addition to the upper wall portion; and the upper wall portion extends from the sidewall portion in a direction intersecting with the up-down direction.

3. The connector as recited in claim 1, wherein:

the end face has an inner side surface and a protruding surface;

the inner side surface intersects with the second direction and is oriented inward in the second direction;

the protruding surface protrudes from the inner side surface in the second direction; and the connection portion is formed on the protruding surface.

4. The connector as recited in claim 1, wherein the upper principal surface is perpendicular to the up-down direction.

5. The connector as recited in claim 1, wherein the connection portion is brought into contact with the mating connection portion when the connector is mated with the mating connector.

6. The connector as recited in claim 1, wherein:

each of the additional members has a regulating portion; and the regulating portion is located upward of the upper principal surface to regulate upward movement of the upper principal surface.

7. The connector as recited in claim 1, wherein each of the additional members has a guide portion extends inward in the second direction and downward in the up-down direction from the upper wall portion.

8. The connector as recited in claim 7, wherein the guide portion has a lower end portion located upward of the upper principal surface of the plate piece portion in the up-down direction to regulate upward movement of the upper principal surface.

9. The connector as recited in claim 1, wherein when each of the additional members is viewed from above along the up-down direction, the connection portion is visible at least in part.

10. The connector as recited in claim 2, wherein:

each of the additional members has two main portions each of which comprises the spring portion, the plate piece portion, the fixed portion and the base portion; and the main portions are located across the receiving portion from each other in the second direction.

11. The connector as recited in claim 10, wherein:

each of the additional members has a coupling portion; and the coupling portion couples the base portions of the main portions to each other.

* * * * *